US005836688A

United States Patent [19]

Eping

[11] Patent Number: 5,836,688

[45] Date of Patent: Nov. 17, 1998

[54] METHOD AND APPARATUS FOR PROCESSING MATERIALS

[75] Inventor: Karl Eping, Trier, Germany

[73] Assignee: Laeis Bucher GmbH, Trier, Germany

[21] Appl. No.: 903,349

[22] Filed: Jul. 30, 1997

Related U.S. Application Data

[63] Continuation of Ser. No. 516,693, Aug. 18, 1995, abandoned.

[30] Foreign Application Priority Data

Aug. 18, 1994 [DE] Germany ..... 4429244.9

[51] Int. Cl.[6] ..... B01F 7/18

[52] U.S. Cl. ..... 366/285; 366/326.1

[58] Field of Search ..... 366/279, 285, 366/254, 255, 207, 261, 201, 292, 295, 296, 326.1, 327.1, 327.3, 327.4, 342, 348, 325.1; 416/205

[56] References Cited

U.S. PATENT DOCUMENTS

| | | | |
|---|---|---|---|
| 3,374,989 | 3/1968 | Todtenhaupt | 366/327.4 |
| 4,090,696 | 5/1978 | Kipke | 366/327.4 |
| 4,238,159 | 12/1980 | Tielens et al. | 366/327.4 |
| 4,456,382 | 6/1984 | Mahler, II | 366/326.1 |
| 4,988,303 | 1/1991 | Thomas | 366/326.1 |

FOREIGN PATENT DOCUMENTS

| | | | |
|---|---|---|---|
| 125 389 | 2/1984 | European Pat. Off. . | |
| 355613 | 11/1905 | France | 366/287 |
| 1460318 | 3/1969 | Germany | 366/287 |
| 2 003 201 | 1/1970 | Germany . | |
| 1949724 | 4/1971 | Germany | 366/285 |
| 314539 | 7/1971 | U.S.S.R. | 366/287 |
| 1459699 | 2/1989 | U.S.S.R. | 366/292 |
| 1789258 | 1/1993 | U.S.S.R. | 366/287 |
| 313351 | 6/1929 | United Kingdom | 366/292 |

*Primary Examiner*—Tony G. Soohoo

*Attorney, Agent, or Firm*—Jacobson, Price, Holman & Stern, PLLC

[57] ABSTRACT

A method of processing flowable materials. In customary methods of this type, the material is impelled by a rotor immersed in the material, with radial and axial restriction of the movement of the material at the boundary layer of the material in contact with the rotor. Such customary methods are hereby improved in that the magnitude and direction of the acceleration impulse(s) imparted to the material are adjusted to the process conditions by changing the configuration of processing implements which extend generally radially out from the rotational axis of the rotor.

5 Claims, 7 Drawing Sheets

METHOD AND APPARATUS FOR PROCESSING MATERIALS

This is a continuation of application Ser. No. 08/516,693, filed Aug. 18, 1995 which was abandoned upon the filing hereof.

BACKGROUND OF THE INVENTION

The invention relates to a method of processing flowable materials, wherein the material is impelled by a rotor assembly immersed in the material, with radial and axial restriction of the movement of the material at the boundary layer of the material in contact with the rotor assembly. The invention also relates to a device for accomplishing the method.

Methods of the type described above are preferred for processing material comprised of a plurality of components some of which are non-liquids which are pourable (or at least capable of forming a flowable slurry) and others of which are liquids. The processing is understood generally to comprise operations such as mixing, cooling, heating, shearing (as with a knife, and shear stressing), disintegrating, deaggregating, agglomerating, comminuting, granulating, kneading, plasticizing, drying, moistening, condensing, densifying, and the like. Ordinarily, all of these operations are carried out in an apparatus referred to as a mixer. Such an apparatus is disclosed, for example, in Eur. AS 0,125,389 B1, and has a structure shown schematically in FIG. 10 of the herewith accompanying drawings. The apparatus is comprised of a vessel 100 having feed opening 101 and an exit opening 102 which exit opening is occludable with a slide valve means 102. A rotor 104 bearing paddle-shaped processing implements 105 is disposed in the vessel 100 and is rotated around a rotor axis 108 with the aid of a drive motor 106 via a drive belt 107. In the mixer illustrated, the rotor axis extends essentially in the direction of gravity. The paddle-shaped implements 105 are disposed with respect to a plane which is perpendicular to the rotor axis 108 in such a way that the material impinging on the implements 105 is impelled downward. To enhance the mixing function, the vessel 100 is rotated around its axis of revolution 112 with the aid of a second drive motor 109, via a gear 110 and a gear rim 111 encircling the circumference of the vessel 100. Toward this end, the vessel 100 is rotatably mounted on rolling bearing means 113.

In order to employ such a mixer to process the starting material, which material may be comprised of a plurality of components, the material is introduced to the interior of the vessel 100 via the feed opening 101 and, by rotating the vessel 100 around the axis of revolution 112 of the vessel 100, the material is brought to the region of the mixing implements 105 of the rotor 104 which rotates around the rotor axis 108. With the aid of the implements 105 rotating around the rotor axis 108, the staring material is then subject to shear action (cutting as well as shear stressing) which brings about mixing, and at the same time the material is impelled toward the bottom of the vessel, thereby leading to a densification of the starting material which has become intermixed by the shear action of the implements (cutting and application of shear stress). After completion of the processing in the vessel 100, the slide valve 102 is opened to unblock the exit opening 103, and the processed material is discharged through the opening. staring As mentioned, in apparatuses of the known type both intermixing and concentrating or densification of the starting material occur simultaneously. It has been found that such simultaneous conduct of two process steps often leads to inadequate processing of the starting material. Thus it has been observed that with a certain disposition of the processing implements the material introduced to the vessel 100 through the feed opening 101 may be conveyed very rapidly to the vessel bottom under the action of the processing implements 105 which are oriented at an incline to an imaginary plane passing perpendicular to the rotor axis. Accordingly, in some cases the starting material does not experience satisfactory intermixing prior to reaching the vicinity of the vessel bottom; in other cases it does experience satisfactory intermixing, long before the desired concentrating or densification of the material is completed, which undesirably prolongs the entire process. To alleviate this drawback, it has been proposed to de-couple the intermixing from the concentrating/densification. Toward this end, in known apparatuses of the type described above the modification has been made that the angle of inclination (pitch angle) (i.e., the angle around the individual longitudinally extending swing axis) of the processing implements 105 is selected to be such that only a shear action (cutting and application of shear stress) is produced and not a concentrating/densifying effect, or is selected such that the material is impelled upward, counteracting gravity (e.g., for the purpose of deaggregating/disintegrating the starting material).

Further, to enhance the processing, the implements fixed to the rotor may be provided with impingement surfaces which serve to disintegrate/deaggregate the starting material (Ger. Pat. 2,003,201 C3).

The desired concentrating/densifying of the material undergoing processing must be accomplished by additional means, in this known variant method. In this connection, for example, it has been proposed to install an edge mill in the vessel, whereby the material being processed can be pressed against the vessel bottom and can be periodically kneaded and compressed. Such an edge mill presents the disadvantage that the densification achievable with it is irregular and therefore minor, particularly when its rolls suffer progressive frictional wear.

According to another proposal, an underpressure is produced in the region of the vessel bottom, in order to promote densifying of the material being processed. This measure does indeed provide sufficiently reliable densification, but the structural features of the mixer which it requires are costly, in the for of a high-throughput pump system to produce the underpressure.

Finally, concentrating/densifying may be achieved by allowing the material being processed to settle for a time, with the vessel blocked. However, this greatly increases the residence time of the material in the vessel, thereby reducing productivity.

SUMMARY OF THE INVENTION

A primary object of the present invention is to provide a method whereby the operations required for the processing of the material, such as mixing, disintegrating, deaggregating, agglomerating, comminuting, granulating, condensing, densifying, kneading, and/or plasticizing, can be carried out in simple and reliable fashion in high throughput, and to provide a device for carrying out such a method.

According to the invention this objective is achieved, with regard to the method, in that at positions of like radius at least two different values of the axial component of the acceleration are imparted to the boundary layer during an operation.

By this expedient, for example, in an initial adjustment phase of the material processing, the processing implement system can be given a configuration which is set and maintained fixed thereafter such that an axial acceleration is provided whereby satisfactory intermixing is achieved as well as the maximum possible rapidity of densification. With the configuration of the processing paddle-shaped implements described above one may, for example, set all of the paddles at a common pitch during the initial phase, and this pitch can be maintained throughout the duration of the process.

The inventive method can also be used to carry out two necessary operations on the materials independently, in order to reliably avoid the problems occurring with the known methods wherein two processing operations are conducted simultaneously. With the inventive method, this separation of the operations does not require the provision of additional processing equipment or a lengthening of the time needed to perform the overall processing.

Because different axial accelerations are imparted to the material at its boundary surfaces at positions of like radius, when carrying out the inventive method (for example, a first acceleration which is nearly zero and a second, nonzero acceleration which depends on the first acceleration), the material can experience the desired mixing via the first acceleration and can experience a densification via the second acceleration.

Further, it is possible to impart two oppositely directed axial accelerations to the boundary layer at positions of like radius with the aid of the rotor, so that, if desired, in interaction with gravity a single rotor may be employed to accomplish both deaggregating (or the like) and densifying (or the like).

The different acceleration values can be brought about by a single fixed three-dimensional form of the rotor and/or by change(s) in this form with time.

The primary object of the present invention is achieved, with regard to the device, by a device comprising a vessel which receives the material being processed, and a rotor which is immersed in the material and which has means for processing the material, wherein the rotor (with its associated means) impels the boundary layer in contact with it. According to the invention, this device is essentially characterized in that is comprises means for setting and changing the form of the processing and accelerating means associated with the rotor, which change of form results in change (s) in the axial acceleration imparted to the boundary layer.

Such a device enables the abovementioned method to be carried out wherein the material being processed received at least two different axial accelerations during one operation. The device also enables methods wherein, in a preliminary step, one determines the values of the axial components of the acceleration to be imparted to the boundary layer, which values are well suited to various types of materials and processing operations. These acceleration values are then incorporated to some extent into the given mixing procedure, wherewith in the actual operation the rotor is set to the value(s) which was/were established in the preliminary step for the given material being processed and the operation being carried out.

For this purpose, the implement arrangement advantageously comprises at least one implement which extends essentially perpendicularly to the rotor axis, has a profiled cross section, and has a pitch which can be adjusted with respect to the plane of rotation.

In this way, boundary layers of like radius on the implement can be impelled axially (with respect to the rotor) to an extent which can be varied by varying the pitch of the implement, and thereby a variety of processing effects can be achieved, without interruption of the course of the processing implement arrangement when changing to a different process regimen.

In carrying out the inventive method it is particularly preferred if three different regimens of axial impulse acting on the boundary layer at a given radius are independently established during a processing operation, which regiments are, for example, associated with deaggregation/disintegration, mixing, and densification, respectively. In this connection, it is further advantageous if different operations are accomplished by control of the acceleration (or impulse) imparted to the boundary layer at a given radius, wherein the control is exerted in a selectable manner.

In the inventive apparatus for carrying out such a method, advantageously the rotor comprises a rotor shaft, wherein the processing implement(s) extend(s) outward from the shaft. The control of the axial impulse imparted to the material by the rotor can be accomplished by means of an adjusting mechanism for tilting and fixing the implement (s). The actuating device for this mechanism may be accommodated in an axial recess in the rotor shaft. In a particularly simple configuration of the inventive apparatus, the processing implement(s) can be adjusted by tilting (rotating) it/them around a radial swing (pivot) axis specific to each implement.

It goes without saying that fixed implements can be mounted on the rotor in addition to those with the adjusting mechanism.

To carry out different processing operations, it is advantageous if the rotor can be driven in two opposite directions of rotation.

It has been found to be particularly advantageous if the processing implement extends from its swing axis in a direction generally counter to the rotational direction of the rotor, for each of the two such direction(s) of rotation. This arrangement ensures that in the event of an overload the pitch of the implement with respect to a plane perpendicular to the rotational axis of the rotor will automatically be reduced, thereby tending to relieve the stress on the implement.

According to another embodiment of the inventive apparatus the rotor is axially displaceable such that it can be completely withdrawn from the material being processed, and such that one can introduce the material to the container prior to immersing the rotor into the material.

It is understood that the material can be subjected to additional process operations in addition to the process being accomplished via the rotor, without interrupting the process; examples of such operations are cooling, heating and moistening.

To assist with the process being accomplished via the rotor, it is further provided according to the invention that the material is processed in a generally rotationally symmetrical vessel, and that the acceleration of the material is further increased (the action of the rotor on the material is enhanced) by rotating the vessel around the center axis of the vessel, at an angle which may be a predetermined angle with respect to the direction of gravity. One advantage which can be afforded by this measure is that the material being processed will be disposed primarily in a radially outer region of the vessel, so that the rotor and its processing implements can continue to exert a satisfactory processing action on the material without needing to extend only over a small part of the cross section of the vessel. With such a vessel rotation arrangement, the implements generally extend from the vessel wall over approximately 40% of the vessel diameter. If it is desired to provide substantial densification of the material after it has been processed, the implements may be made large, such as to extend from the wall of the vessel to a point beyond the center of the vessel.

The apparatus for carrying out the inventive method preferably comprises an essentially rotationally symmetrical vessel, with a rotational drive mechanism for driving the vessel in rotation around the center axis of the vessel, and/or a rocking drive mechanism for inclining the vessel around a rocking axis disposed perpendicularly to the center axis of the vessel. In an apparatus of this type which has a structure which provides particularly reliable operation, the rotor is mounted with respect of the vessel in such a way that for any tilt angle of the vessel the rotational axis of the rotor will be at least approximately parallel to the rotational axis of the vessel.

The optimize the processing method, the inventive apparatus may further comprise control means for controlling at least one of the apparatus parameters: angular velocity of the vessel in rotation, angular velocity of the rotor, tilt position of the vessel, pitches of the processing implements, and depth of immersion of the rotor in the material. These control means are preferably programmable.

To further increase the reliability of the processing of the material, it may be provided that a measuring device for determining the condition of the material being processed is connected to the input of the control means.

The efficiency or effectiveness of the inventive method can be increased if different accelerations (impulses) are imparted to boundary layers of levels of the material which are disposed at different positions with respect to (along) the longitudinal direction of the rotor axis but at like radial positions with respect to the rotor axis.

To carry out the inventive method the implement arrangement comprises a plurality of processing implements which rotate (or execute a similar sweeping movement) at an axial spacing from each other with respect to (along) the rotor axis.

With such an arrangement of the implement assembly it is particularly advantageous if the pitches of two axially separated implements are mutually independently adjustable.

To achieve a particularly simple arrangement which dispenses with the abovementioned adjusting mechanism, conceivably all of the processing implements at a given axial altitude along the rotor axis may be fixed to the rotor shaft at a single pitch of the implements, wherein implements are provided at least at two such axial positions, with the pitch angle of the implements in the one axial position differing from the pitch angle of the implements in the other.

In particular, with the last-described embodiment of the inventive apparatus it is possible to operate the apparatus in a continuous-feed mixing mode wherein starting materials are continuously fed to the vessel and materials are discharged through an exit opening of the container at a corresponding rate (in units of mass per unit time or volume per unit time).

The invention will be described in detail hereinbelow with reference to the accompanying drawings, all features of which are here expressly incorporated by reference to the extent not further mentioned in the present specification.

DETAILED DESCRIPTION OF THE PREFERRED EMBODIMENTS

Figure 1:
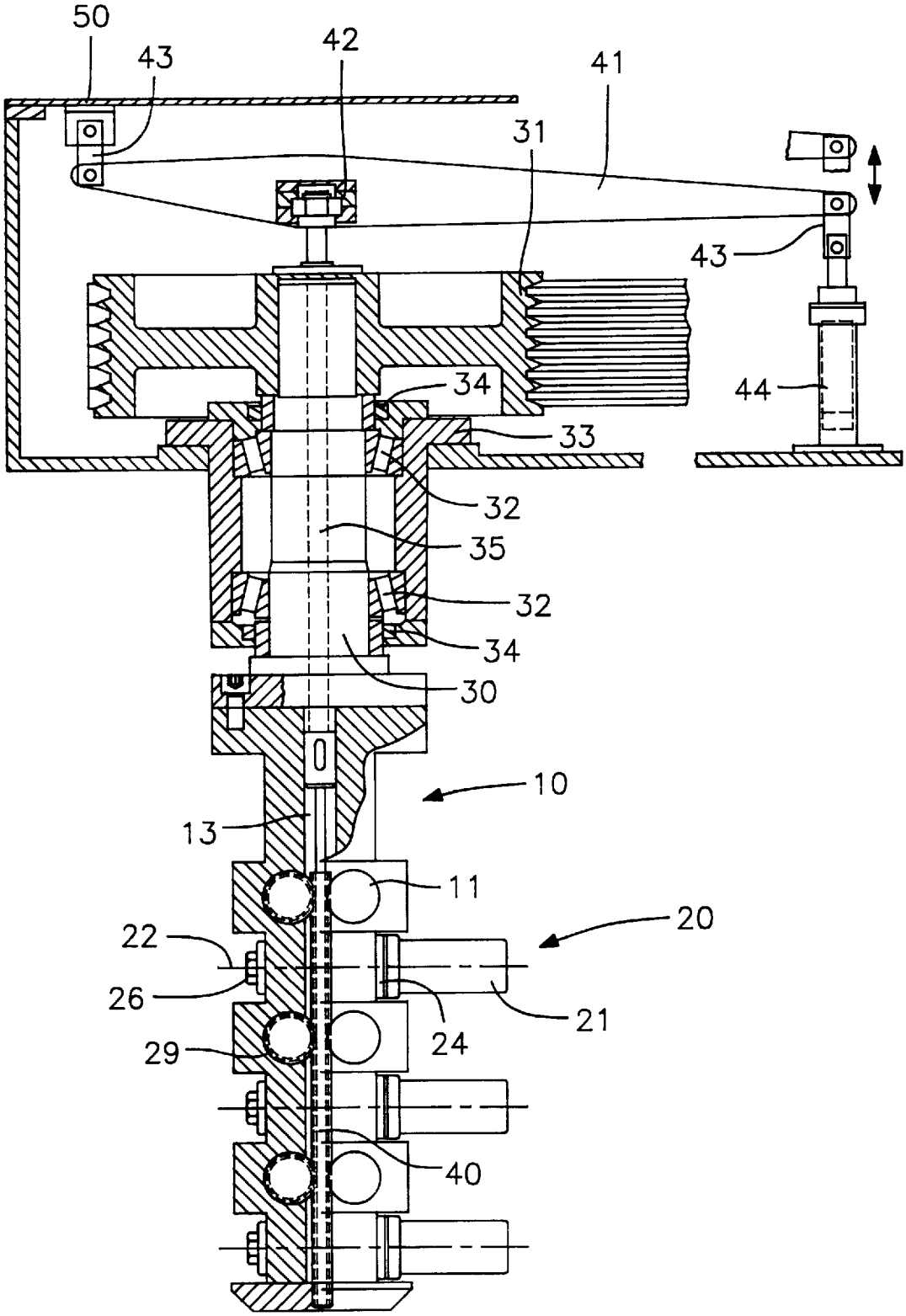
FIG. 1 is a cross sectional view of a rotor which is mountable in a device according to the invention, and the drive mechanism for the rotor.
Figure 10:
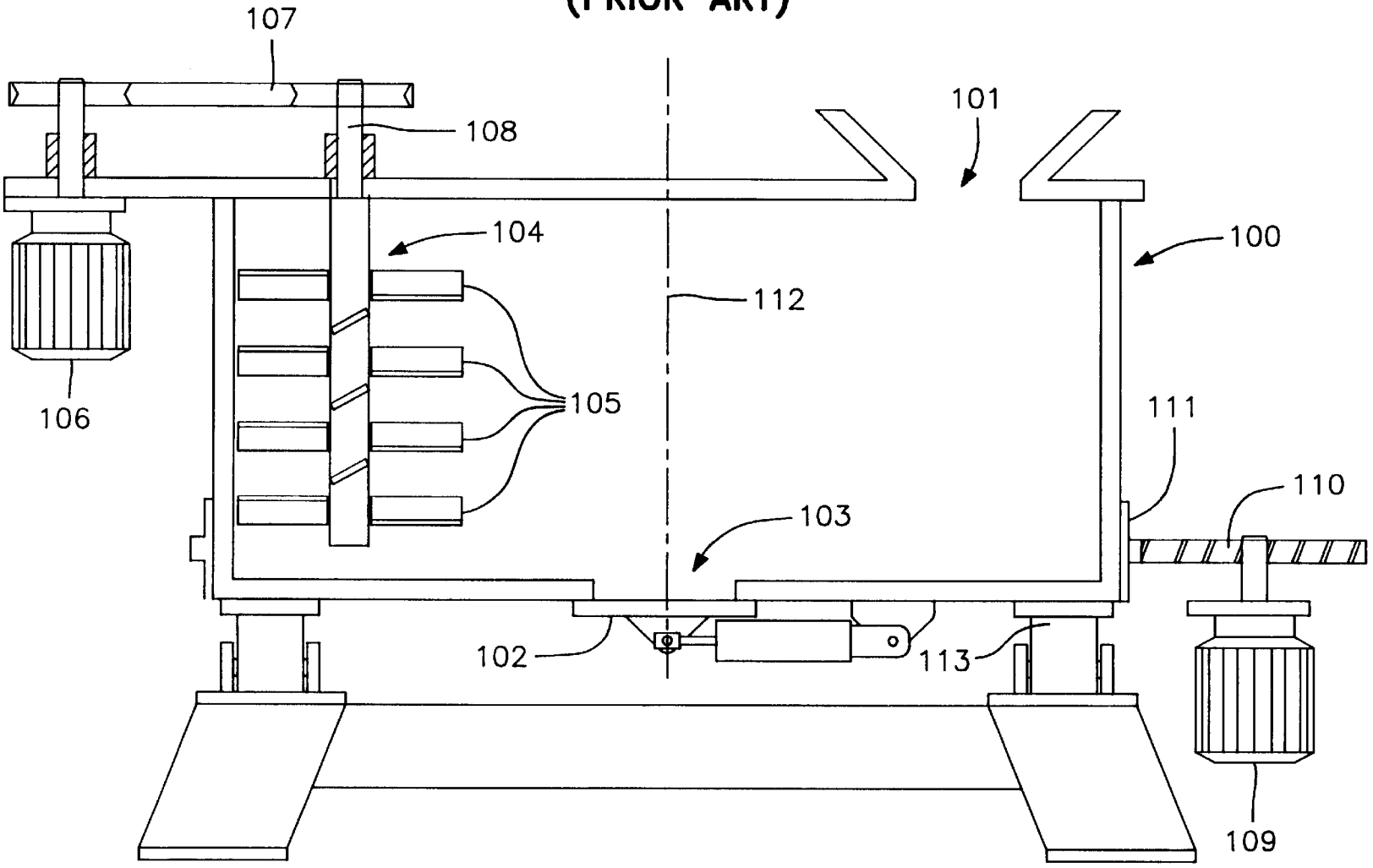
FIG. 10 (PRIOR ART)
FIG. 10 is a mixer according to the state-of-the-art.

FIG. 1 shows a rotor which according to the invention can be installed in a mixer similar to that of FIG. 10. Also shown in FIG. 1 is a drive mechanism for the rotor. The rotor comprises a rotor shaft 10 on which a plurality of processing implements 20 having paddle-shaped processing regions 21 are tiltably mounted on swing axes 22 extending perpendicularly to the rotor axis. The implements 20 are mounted in pairs in respective planes which are perpendicular to the rotor axis, which planes are spaced a uniform axial distance apart. The upper end of the rotor 10 is rigidly fixed to a rotatable drive shaft 30 which presents a belt pulley 31 rigidly fixed to its upper end for rotation therewith. The drive shaft 30 and thereby the rotor are rotatable via the pulley 31 with the aid of a drive motor (not shown). The drive shaft 30 is mounted in a fixed bearing housing 33 with the aid of antifriction bearings 32. Seals 34 are disposed on the axial ends of the bearing housing 33 between the housing 33 and the drive shaft 30, to exclude soils from the bearing housing which might adversely affect the bearings.

The drive shaft 30 has a thoroughgoing cylindrical bore 35 extending along its axis of rotation. This bore is continued in the rotor shaft by a thoroughgoing recess 13 extending along the rotational axis of the rotor shaft. A cylindrical rack 40 is axially slidably disposed in the cylindrical bore 35 and recess 13, which rack 40 enables the implements 20 to be rotated around their respective swing axes 22, as will be described in more detail below. The axial upper end of the cylindrical rack 40 is rotatably accommodated in a bearing 42 disposed on a pivoted lever 41. Lever 41 is provided with articulated links 43 on its two ends, to form two double joints. The end of one articulated link 43 which end is farthest from the lever 41 is pivotally mounted to a drive housing 50, whereas the other articulated link 43 (which link is mounted on the other end of lever 41) has a distal end pivotally mounted to a piston jack 44. This arrangement enables the cylindrical rack 40, which is rotatable but is fixed to the bearing 42 in the axial direction, to be displaced axially in the cylindrical bore 35 and the recess 13, namely by operating the jack 44.

Figure 2:
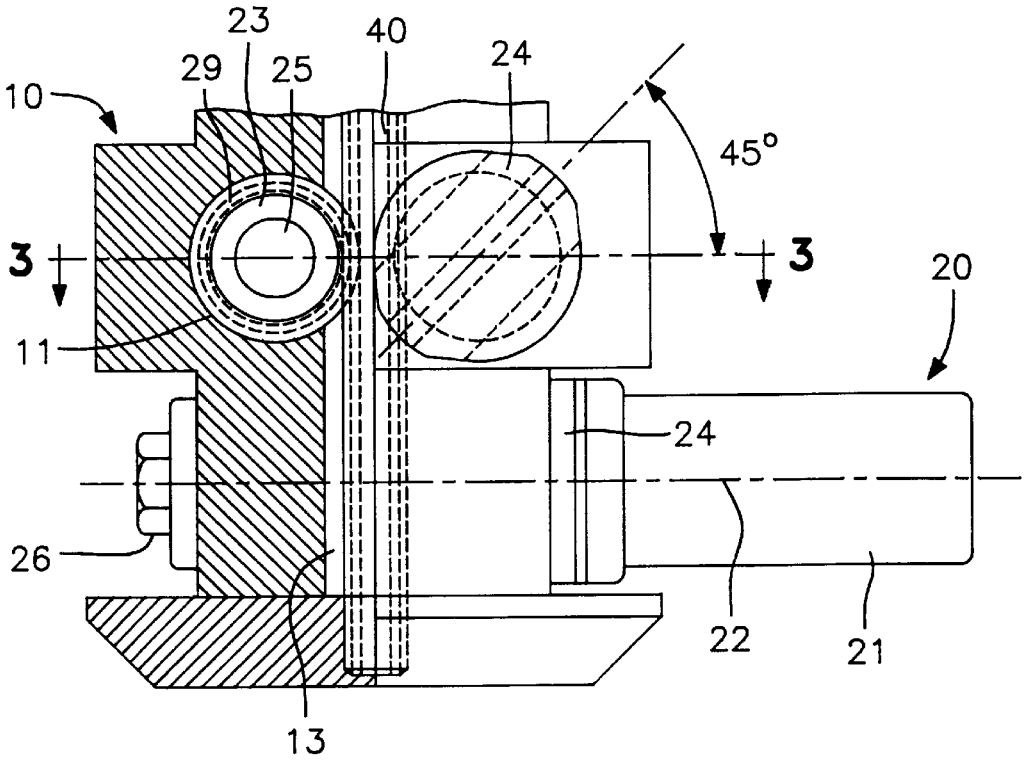
FIG. 2 is an enlarged cross section of the lower end of the rotor illustrated in FIG. 1.

As will be explained with reference to FIGS. 2 and 3, the described axial displacement of the cylindrical rack 40 can work a tilting of the implements 20 around their respective swing axes 22. For this purpose each implement 20 has an essentially cylindrically shaped continuation 23 on its proximal end directed toward the rotor shaft, which continuation engages a bore 11 provided in the rotor shaft, which continuation engages a bore 11 provided in the rotor shaft, which bore extends perpendicularly (but in a non-intersecting manner) to the rotor axis at a radial distance A from the rotor axis. To limit the penetration of the implement 20 into its corresponding bore 11, a detent 24 is provided on the implement 20, which detent can come to abut against a correspondingly formed detent surface 12 on the rotor shaft 10. The cylindrical continuation 23 of the implement 20 has a circular cross section in the neighborhood of the detent 24 which cross section is accurately fitted to that of the cylindrical bore 11. With further progression along the continuation 23 in the direction away from the main body of the implement 20, the cross section of the continuation 23 becomes narrower, such that at the distal end of the continuation which distal end is directed away from the detent 24 of the continuation engages a correspondingly narrowed part of the bore 11 in rotor shaft 10, also with an accurate fit.

Figure 3:
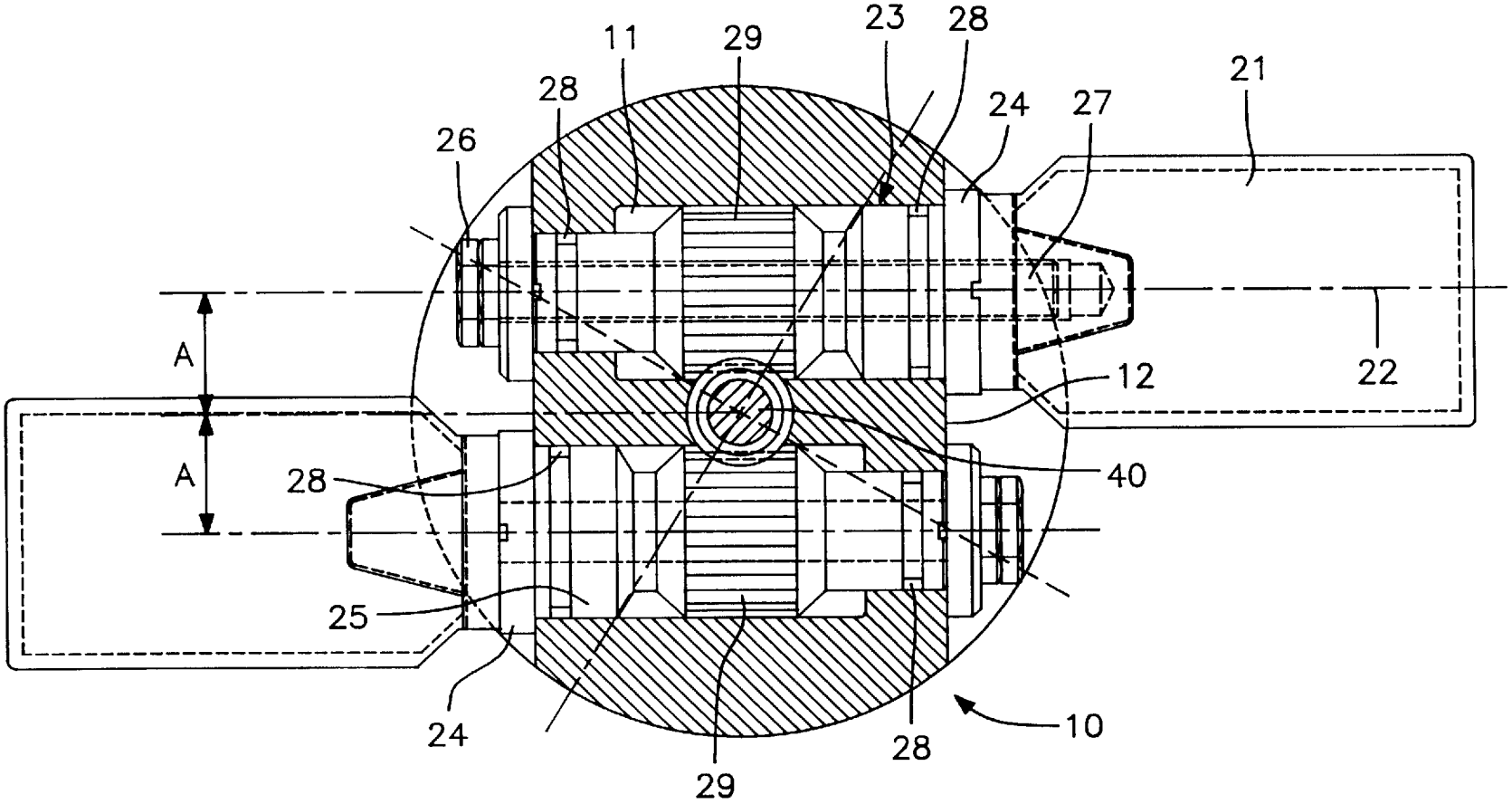
FIG. 3 is a cross section through the horizontal plane defined by lines B–A of FIG. 2, of a rotor which is a component of the a device according to the present invention.
Figure 5:
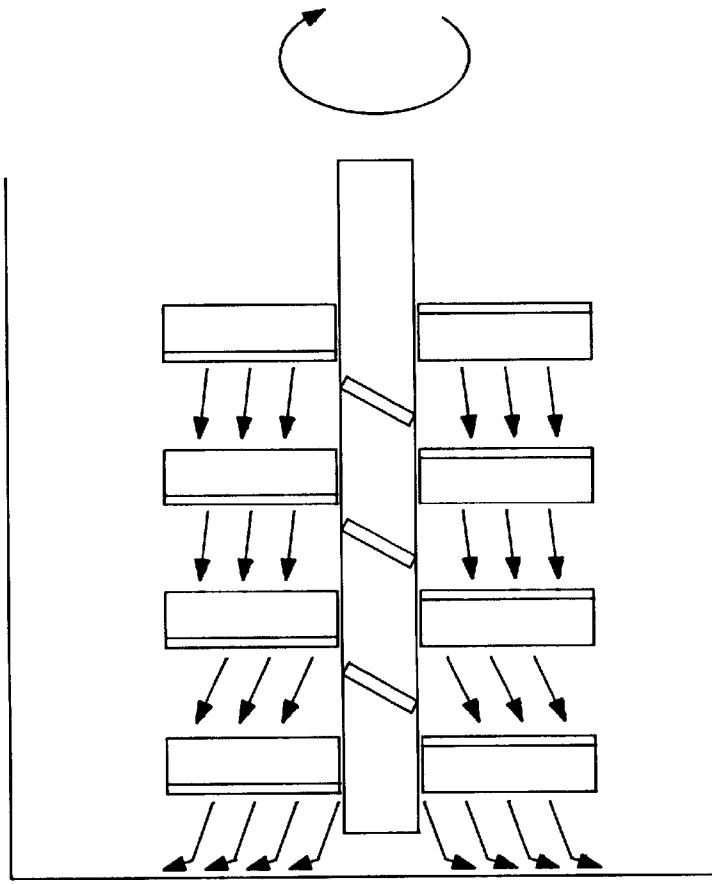
FIGS. 4 to 8 are schematic representations which show the effects of a rotor which is a component of the device according to the invention.
Figure 4:
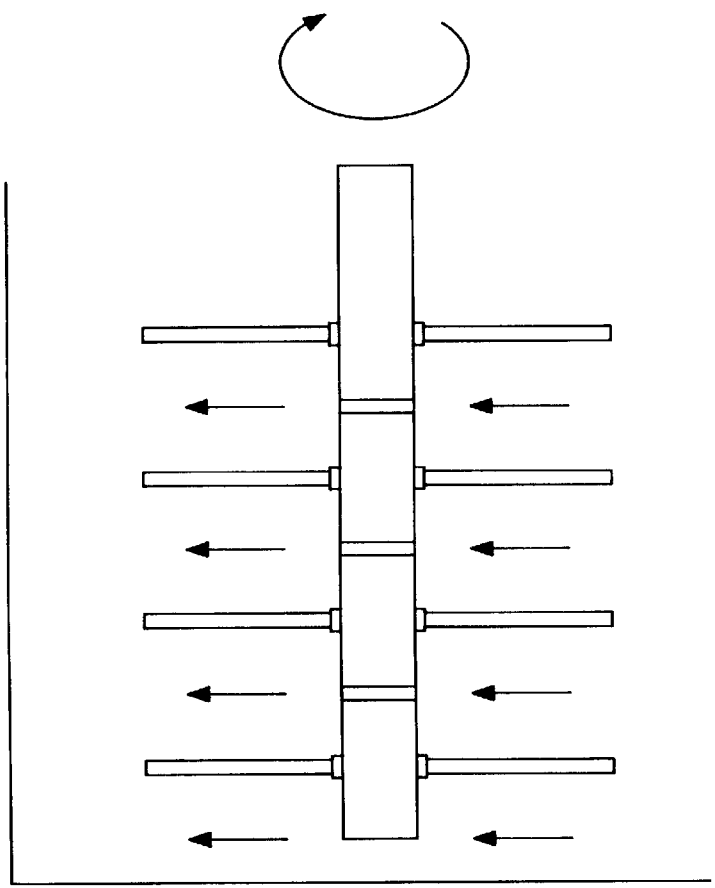

As may be seen particularly well from the cross sectional view of FIG. 3, a toothed ring 29 is rigidly fixed to the continuation 23 of implement 20 along the segment of continuation 23 having reduced cross section. The tooted ring 29 and bore 11 are disposed in the rotor shaft 10 such that the toothed ring 29 engages the rack 40 extending in the recess 13. In this way the implement 20 can be tilted around a rotational axis 22 which passes through the center of the cylindrical continuation 23, by means of an axial displacement of the cylindrical rack 40, whereby the pitch angle of the paddle-shaped processing region 20 can be changed with respect to a plane extending perpendicularly to the rotor axis.

As may be seen particularly clearly in FIG. 3, processing implements 20 disposed in a same radial plane with respect to the rotor shaft 10 are disposed essentially parallel to each other, with opposite axial orientations. Thereby one can change the pitch of both such implements equally with respect to the rotational direction, with the use of a single cylindrical rack 40.

To avoid problems with the tilting of the implements 20 via the cylindrical rack 40, which problems may be caused by the mounting of the implements 20 with the aid of mounting screws 26, it is advantageous if the cylindrical continuation 23 is slightly longer than the corresponding bore 11 in the rotor shaft. Then penetration of material undergoing processing into the cavity formed by the bore can be prevented by installing seal rings in grooves 28 encircling the cylindrical continuation 23 (see FIG. 3).

In the embodiment of a rotor usable in according to the invention which embodiment is illustrated in FIG. 1, the pitches of all of the processing implements 20 are adjusted with the use of only a single cylindrical rack 40. If it is desired that the control of the pitch of a given implement 20 be, for example, a function of the altitude of the implement, a plurality of cylindrical racks generally similar to rack 40 may be provided in the recess 13 and the cylindrical bore 35, which racks may extend coaxially therein (or for simplicity may be mounted on a single bar therein but be of different gear pitches or gear ratios). If the toothed rings 29 of the implements 20 disposed at the respective altitudes were correspondingly configured, one would achieve adjustment of the impelling pitches of the implements 20 which could be independently different for each such altitude.

FIGS. 4 to 8 illustrate various processing steps which could be executed in the course of a materials processing operation. If via the cylindrical rack 40 the implements 20 are oriented such that their pitch angle with respect to a plane perpendicular to the rotor shaft is zero (FIG. 4), the boundary layers of the material being processed which are in contact with the rotor and the implements thereof will be impelled in a direction which is essentially perpendicular to the rotor shaft 10. Thus with this orientation of the implements 20 the material being processed will undergo essentially a shear action (cutting, and, to a greater or lesser extent, application of shear stress) and intermixing. After satisfactory intermixing of the material has been achieved in this way (for example, of a possibly non-liquid raw material and one or more liquids to be intermixed therewith), the pitch of the implements 20 can be changed to that shown in FIG. 5, with the aid of the cylindrical rack 40. Here the pitch with respect to a plane perpendicular to the rotor axis is such that the material being processed (particularly its interface in contact with the rotor and the implements 20 thereof) is impelled axially downward as the rotor is rotated, resulting in the desired densification of the material. Using the pitches illustrated in FIGS. 4 and 5, and with suitable choices of the respective processing times, one can reliably provide both a satisfactory intermixing and a sufficient densification of the material being processed with only a single rotor, in a single operation, and for any admissible combination of characteristics of the material. The processing time can be minimized if the characteristics of the material can be determined (for example, by a measuring device), wherein this information is used in controlling the pitch of the implements 20.

Figure 6:
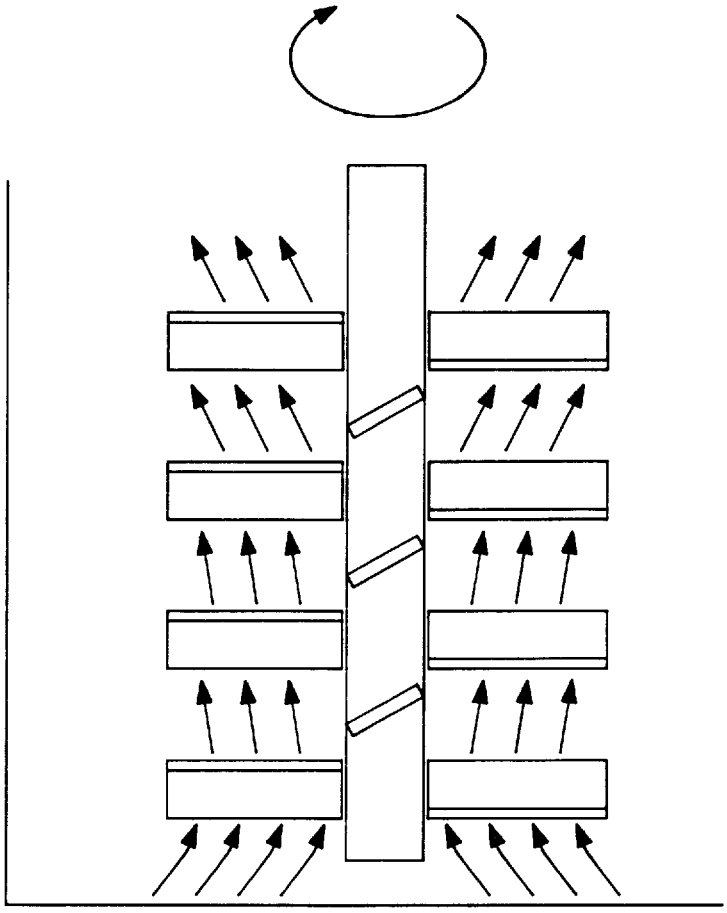

If necessary, the processing implements 20 may also be oriented in the pitch shown in FIG. 6 at some time during the processing of the material. In FIG. 6, the pitch with respect to the direction of rotation of the rotor is such that the boundary layer of the material being processed, which layer is in contact with the rotor and implements 20 thereof, is impelled upward. By this expedient one can additionally achieve deaggregation/disintegration of the material.

Figure 7:
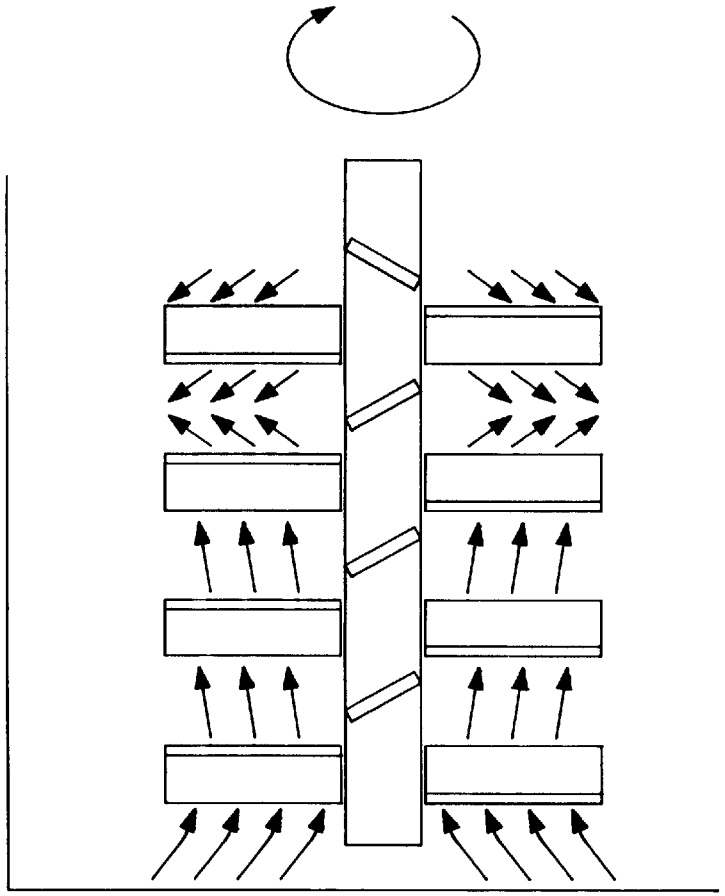

Using the opposed pitches of the processing implements 20 which pitches are illustrated in FIG. 7, one can have deaggregation of the material occurring in the lower region of the rotor while in the upper region the material is propelled away from engagement by the rotor. The resulting circulation of the material increases the rate of overall intermixing of the material.

Figure 8:
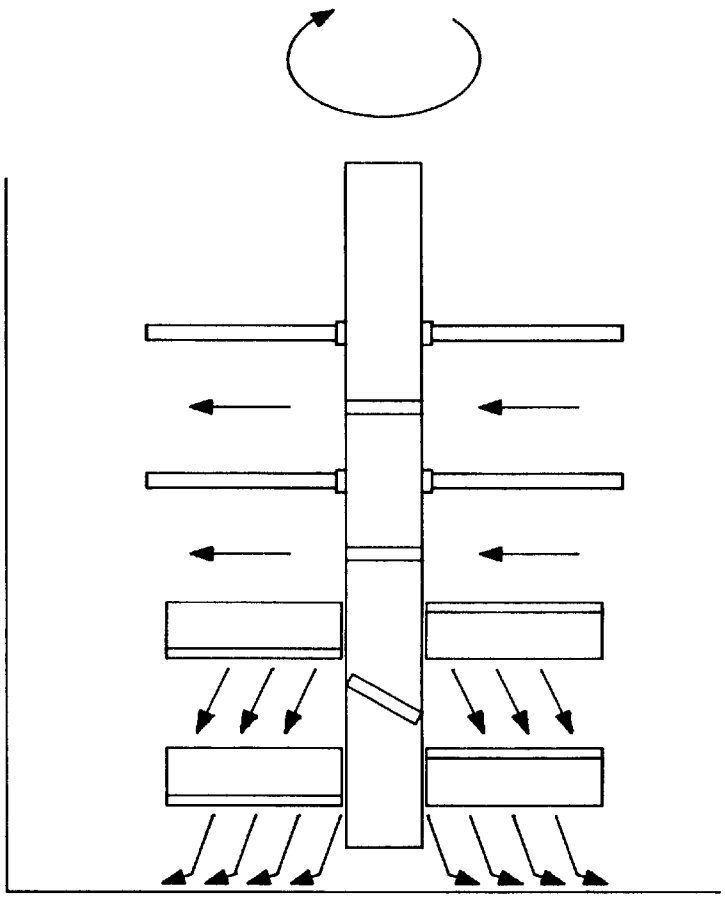

Finally, with the orientations of the processing implements 20 shown in FIG. 8 one can have shearing (cutting and shear stressing) of the material in the upper region, which promotes intermixing, while in the lower region as a result of an appropriate pitch of the implements 20 the material which has been intermixed in the upper region is impelled axially downward into the lower region, where densification is accomplished. In particular, these orientations of the implements 20 may be used as fixed orientations with which the device is operated in a continuous flow mode (rather than a batch mode), wherein the (possibly non-liquid) raw material and the other components to be intermixed are added continuously in the desired proportions and material is discharged from an exit opening at a rate corresponding to the rate of the feeding. With this mode of operation it is unnecessary for the pitches of the various processing implements 20 to be adjustable, but rather the implements may be fixed to the rotor shaft at these orientations.

Figure 9:
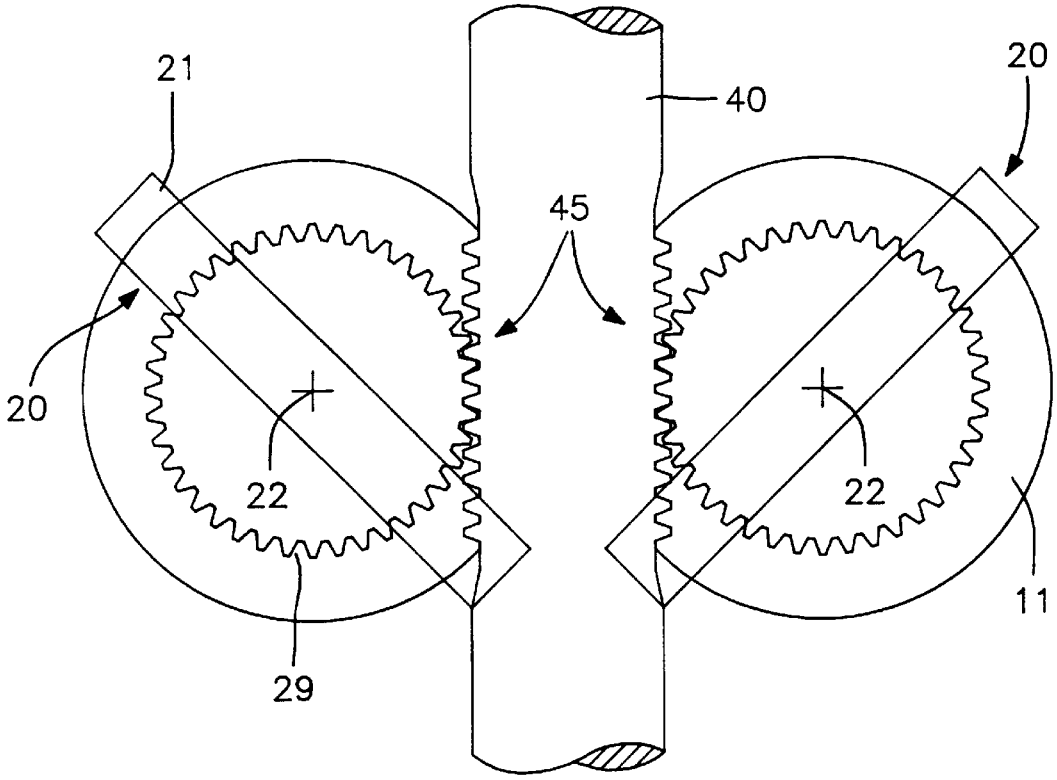
FIG. 9 is a schematic representation of control means for the processing implements in a device according to the invention.

FIG. 9 shows alternative means of controlling the pitches of the processing implements 20. Here the teeth 45 on the cylindrical rack (which rack extends through the cylindrical bore 35 and the recess 13) are present only on certain axial segments of the bar of which the rack is comprised, namely in the region of altitudes at which the implements 20 are disposed. This configuration for the cylindrical rack 40 and toothed rings 29 allows convenient limitation of the range of tilting of the implements 20, which range may be, for example, −45° to +45° with respect to a plane perpendicular to the rotor shaft 10. Such a limitation may be useful to ensure that the rotor does not encounter excessive resistance to its rotation via forces exerted by the material being processed, namely forces acting against implements 20 which have unintentionally been oriented at an excessive pitch.

The invention is not limited to the exemplary embodiments set forth in detail above. Multifarious variant embodiments can be conceived which comprise refinements and/or otherwise do not depart from the scope of the invention. For example, the implements in an inventive device may further be supplied with impingement surfaces which enhance or cause disintegration and deaggregation of the material being processed. Further, a plurality of rotors can be employed in a single inventive device. Also, other processing means can be disposed in or on the vessel, for example, cooling and heating means.

I claim:

1. An apparatus for processing at least one flowable material, said apparatus comprising:

a vessel for accommodating said at least one flowable material; and a rotor having an arrangement of process implements extending out from the rotor, said rotor being rotatable in at least one rotational direction and immersible in said at least one flowable material so as to impel a boundary layer of said at least one flowable material in contact with said rotor;

said arrangement of process implements including at least one process implement extending out from said rotor substantially perpendicularly with respect to a rotational axis of said rotor, said at east one process implement having a cross sectional profile defining a pitch with respect to a rotational plane of said at least one process implement and being mounted on said rotor in a rotatable manner with respect to an implement axis extending radially out from said rotor, and said rotor including a rotor shaft defined at the rotational axis of the rotor, said rotor shaft having an axially extending recess accommodating an actuating mechanism operable for adjusting said pitch of said at least one process implement to thereby modify axial accelerations imparted on said boundary layer by said rotor.

2. The apparatus according to claim 1, wherein said rotor further comprises at least one additional process implement having a fixed pitch with respect to a rotational plane thereof.

3. The apparatus according to claim 1, wherein said at least one process implement extends out from the implement axis in a direction generally counter to said at least one rotational direction of said at least one process implement around a rotational axis of the rotor.

4. The apparatus according to claim 1, wherein said arrangement of process implements comprises a plurality of process implements which rotate with said rotor about a rotational axis of said rotor, said plurality of process implements being axially spaced apart from one another with respect to the rotor.

5. The apparatus according to claim 4, wherein each of said plurality of process implements has a pitch defined with respect to a rotational plane of each process implement, and at least two axially spaced ones of said process implements are adjustable independently of one another.

* * * * *

UNITED STATES PATENT AND TRADEMARK OFFICE

CERTIFICATE OF CORRECTION

PATENT NO. : 5,836,688
DATED : November 17, 1998
INVENTOR(S) : Eping

It is certified that error appears in the above-identified patent and that said Letters Patent is hereby corrected as shown below:

Column 6, line 4, "B-A" should read -- 3-3 --.

Signed and Sealed this

Sixteenth Day of March, 1999

*Attest:*

Q. TODD DICKINSON

*Attesting Officer*

*Acting Commissioner of Patents and Trademarks*